US005269655A

United States Patent [19]

Chang

[11] Patent Number: 5,269,655

[45] Date of Patent: Dec. 14, 1993

[54] MULTI-SECTIONAL CENTRIFUGAL BLOWER FAN UNIT

[76] Inventor: Song-Hai Chang, No. 23, Lane 420, Min An Rd., Hsin Chuang City, Taipei Hsien, Taiwan

[21] Appl. No.: 5,469

[22] Filed: Jan. 15, 1993

[51] Int. Cl.[5] ..... B63H 1/26

[52] U.S. Cl. ..... 416/178; 416/187; 416/204 R

[58] Field of Search ..... 416/178, 187, 204 R, 416/207, 213 R, 214 R

[56] References Cited

U.S. PATENT DOCUMENTS

| | | | |
|---|---|---|---|
| 3,156,408 | 11/1964 | Whitenack, Jr. | 416/178 |
| 3,358,913 | 12/1967 | Beesley | 416/178 |
| 3,385,511 | 5/1968 | Wentling | 416/178 |
| 3,694,881 | 10/1972 | Glucksman | 416/178 |
| 3,816,023 | 6/1974 | Shaver | 416/187 |
| 4,329,118 | 5/1982 | Ranz | 416/178 |
| 4,436,484 | 3/1984 | Temple et al. | 416/178 |
| 5,165,855 | 11/1992 | Ricketts et al. | 416/214 R |

FOREIGN PATENT DOCUMENTS

| | | | |
|---|---|---|---|
| 19309 | 2/1977 | Japan | 416/178 |
| 104598 | 8/1980 | Japan | 416/187 |
| 161997 | 12/1980 | Japan | 416/178 |
| 46093 | 3/1982 | Japan | 416/178 |

*Primary Examiner*—John T. Kwon

*Attorney, Agent, or Firm*—Robbins, Berliner, Carson

[57] ABSTRACT

A centrifugal fan assembly consisting of a number of centrifugal fan units. Each of the centrifugal fan units comprises (a) an annular member with a first side and a second side, (b) a number of blades integrating with and extending from said first side, (c) a number of grooves formed in said second side of said annular member, (d) a first device for guiding said blades formed on one centrifugal fan unit to enter in said grooves formed in another centrifugal fan unit even if there is a slight circumferential misalignment of said blades formed on one centrifugal fan unit between said grooves formed in another centrifugal fan unit and (e) a second device for guiding said blades formed on one centrifugal fan unit to enter in said grooves formed in another centrifugal fan unit even if there is a slight radial misalignment of said blades formed on one centrifugal fan unit between said grooves formed in another centrifugal fan unit.

5 Claims, 9 Drawing Sheets

MULTI-SECTIONAL CENTRIFUGAL BLOWER FAN UNIT

BACKGROUND OF INVENTION

1. Field of Invention

The present invention relates to a multi-sectional centrifugal blower fan unit .

2. Related Prior Art

Conventionally, centrifugal sets are used for air conditioners. Each centrifugal set consists of a number of units dependent on the desired length thereof. However, it is difficult to combine those units. Therefore, the present invention is intended to solve the above-mentioned problem.

SUMMARY OF INVENTION

It is an object of the present invention to provide a multi-sectional centrifugal blower fan unit.

For a better understanding of the present invention and objects thereof, a study of the detailed description of the embodiments described hereinafter should be made in relation to the accompanying drawings.

DETAILED DESCRIPTION OF PREFERRED EMBODIMENTS

The present invention will be described in detail with reference to FIGS. 1–10 illustrating preferred embodiments of the present invention.

However, a centrifugal fan set consisting of two centrifugal fan units in accordance with prior art will be described with reference to FIGS. 11 and 12 in priority for better understanding of the features and advantages of the present invention.

Figure 11:
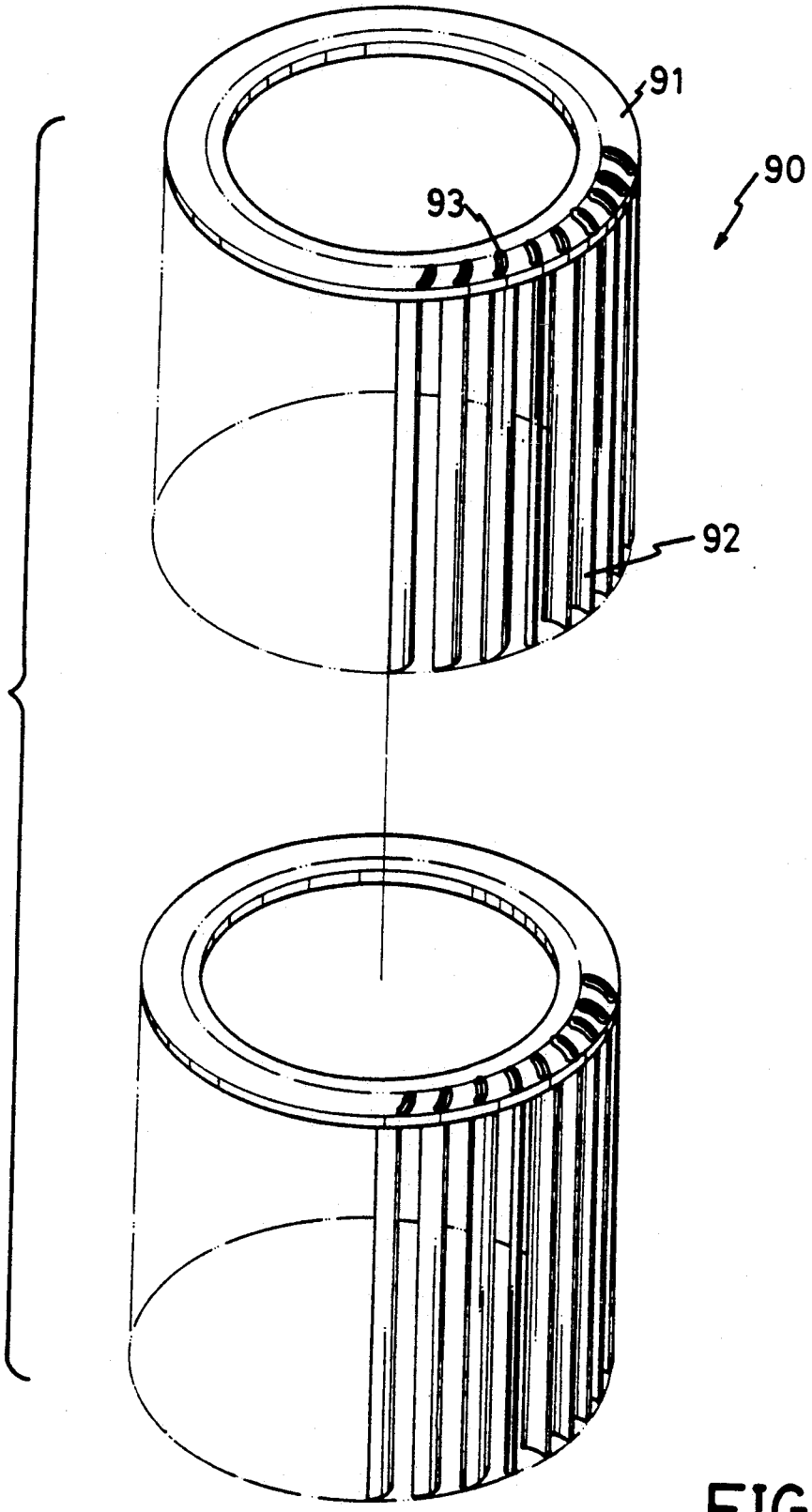
FIG. 11 PRIOR ART
FIG. 11 is a perspective view of two centrifugal fan units before combination thereof in accordance with prior art.
Figure 12:
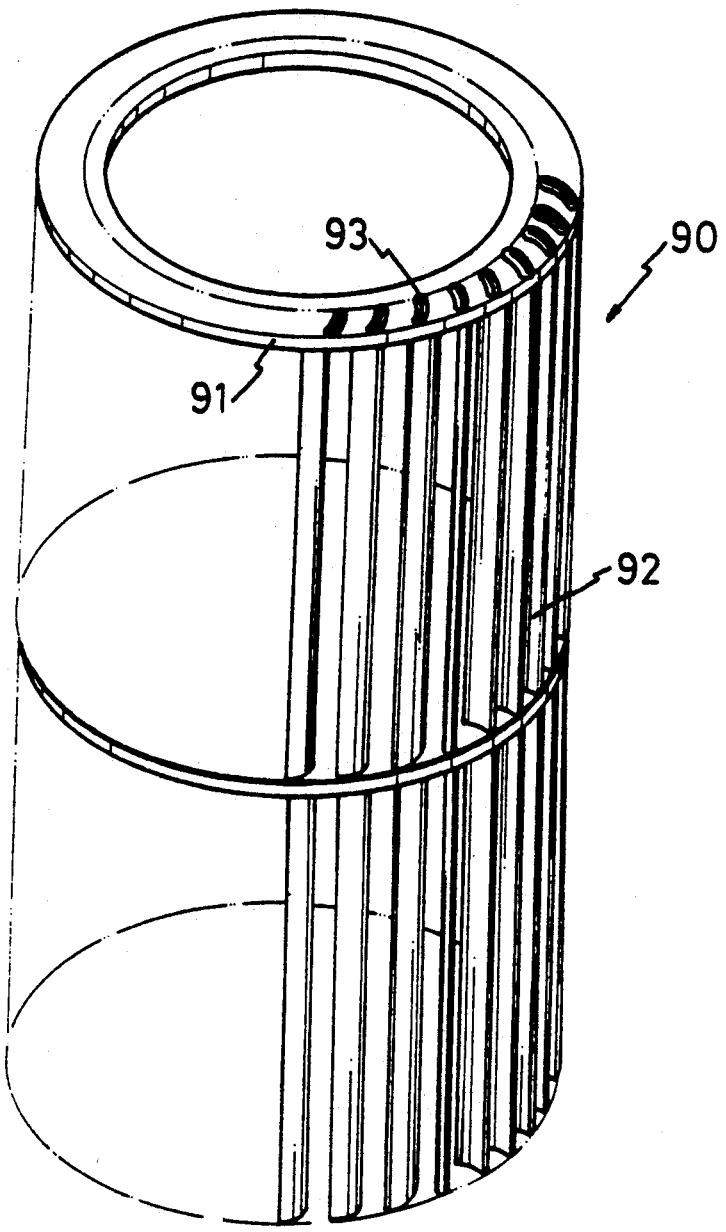
FIG. 12 PRIOR ART
FIG. 12 is a perspective view of a centrifugal fan set consisting of two centrifugal fan units in accordance with prior art.

Referring to FIG. 11, two separate centrifugal fan units 90 are shown. Each of the centrifugal fan units 90 consists of an annular member 91, a number of blades 92 and a number of grooves 93. The annular member 91 has a first side and a second side. The blades 92 integrate with and extend from the first side of the annular member 91. The grooves 93 are formed in the second side of the annular member 91. The free ends of the blades 92 formed on one of the centrifugal fan units 90 are firmly received in the grooves 93 formed in the remaining of the centrifugal fan units 90 by appropriate means, heating or adhesion. The free ends of the blades 92 formed on one of the centrifugal fan units 90 must be sited in the grooves 93 formed in the remaining of the centrifugal fan units 90 at the same time. It is very time-consuming to do that as the grooves 93 are narrow. The present invention provides a centrifugal fan unit which can be combined more easily.

The present invention will be described in detail with reference to FIGS. 1–10 illustrating preferred embodiments thereof.

Figure 1:
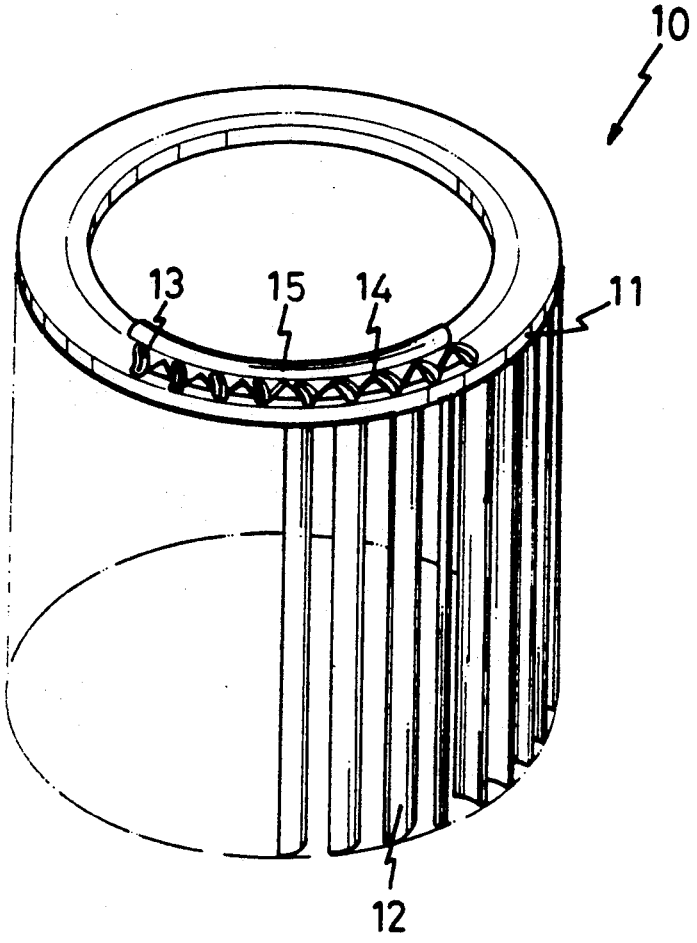
FIG. 1 is a perspective view of a centrifugal fan unit in accordance with a first embodiment of the present invention.

Initially referring to FIG. 1 illustrating a first embodiment of the present invention, a centrifugal fan unit 10 consists of an annular member 11 with a first side and a second side. A number of blades 12 integrate with and extend from the first side of the annular member 11.

Figure 2:
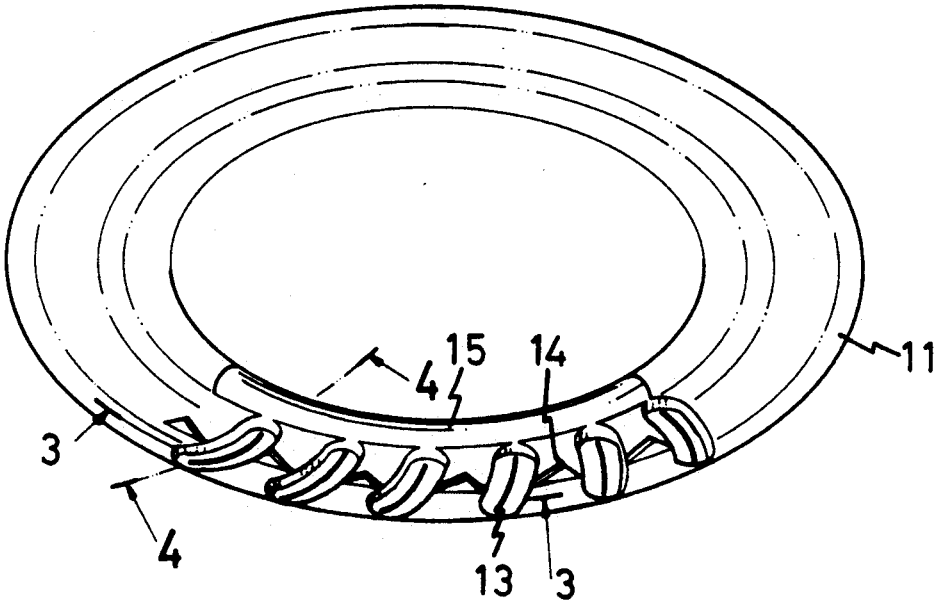
FIG. 2 is a perspective view of an annular member of a centrifugal fan unit in accordance with a first embodiment of the present invention.

Additionally referring to FIG. 2, the improvement of the present invention over prior art is about the annular member 11. A number of grooves 13 are formed in the second side of the annular member 11. A number of guides 14 are formed on the second side of the annular member 11. An annular guide 15 is formed on the second side of the annular member 11, along an inner edge.

Figure 3:
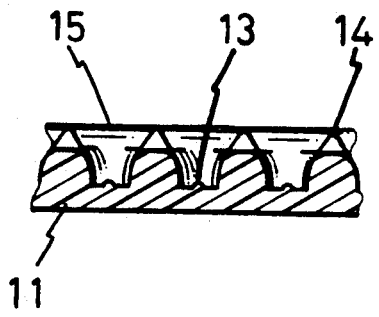
FIG. 3 is a vertical cross-sectional view taken along a line 3—3 in FIG. 2.

Additionally referring to FIG. 3, the grooves 13 and the guides 14 are alternatively arranged. Each of the guides 14 has a triangular configuration with two inclined rims. The inclined rims of the guides 14 permit the blades 12 formed on one centrifugal fan unit 10 to enter in the grooves 13 formed in another centrifugal fan unit 10 even if there is a slight circumferential misalignment of the blades 12 with the grooves 13.

Figure 4:
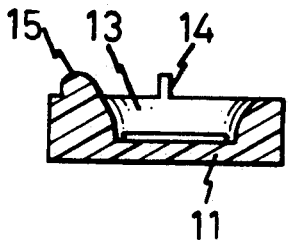
FIG. 4 is a vertical cross-sectional view taken along a line 4—4 in FIG. 2.

Referring to FIG. 4, the annular guide 15 has an inclined side permitting the blades 12 formed on one centrifugal fan unit 10 to enter in the grooves 13 formed in another centrifugal fan unit 10 even if there is a slight radial misalignment of the blades 12 with the grooves 13.

Figure 5:
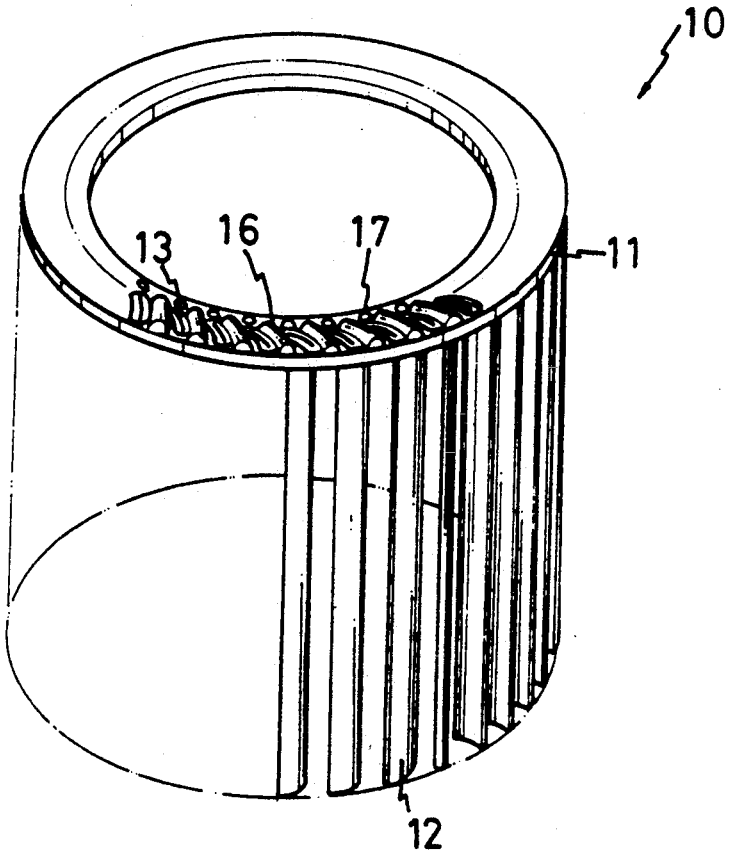
FIG. 5 is a perspective view of a centrifugal fan unit in accordance With a second embodiment of the present invention.

Referring to FIG. 5 illustrating a second embodiment of the present invention, a centrifugal fan unit 10 consists of an annular member 11 with a first side and a second side. A number of blades 12 integrate with and extend from the first side of the annular member 11.

Figure 6:
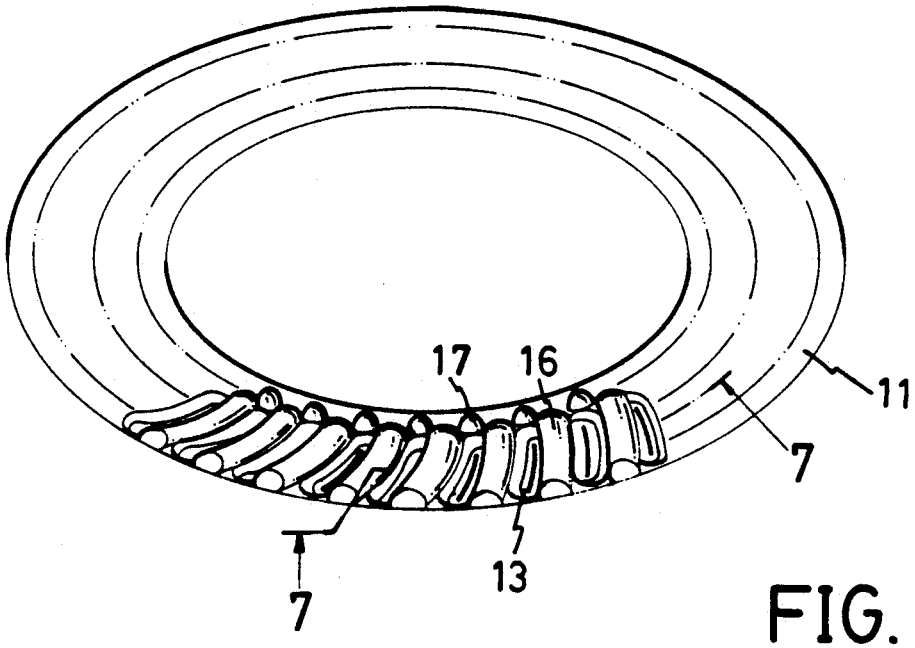
FIG. 6 is a perspective view of an annular member of a centrifugal fan unit in accordance with a second embodiment of the present invention.

Additionally referring to FIG. 6, a number of grooves 13 are formed in the second side of the annular member 11. A number of guides 16 are formed on the second side of the annular member 11. A number of guides 17 are formed on the second side of the annular member 11.

Figure 7:
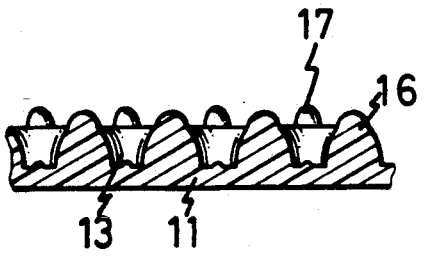
FIG. 7 is a vertical cross-sectional view taken along a line 7—7 in FIG. 6.

Additionally referring to FIG. 7, the grooves 13 and the guides 16 are alternatively arranged. Each of the guides 16 has a cylindrical configuration with two inclined sides. The inclined sides of the guides 14 permit the blades 12 formed on one centrifugal fan unit 10 to enter in the grooves 13 formed in another centrifugal fan unit 10 even if there is a slight circumferential misalignment of the blades 12 with the grooves 13.

Each of the guides 17 has a semi-spherical configuration. The guides permit the blades 12 formed on one centrifugal fan unit 10 enter in the grooves 13 formed in another centrifugal fan unit 10 even if there is a slight radial misalignment of the blades 12 with the grooves 13.

Figure 8:
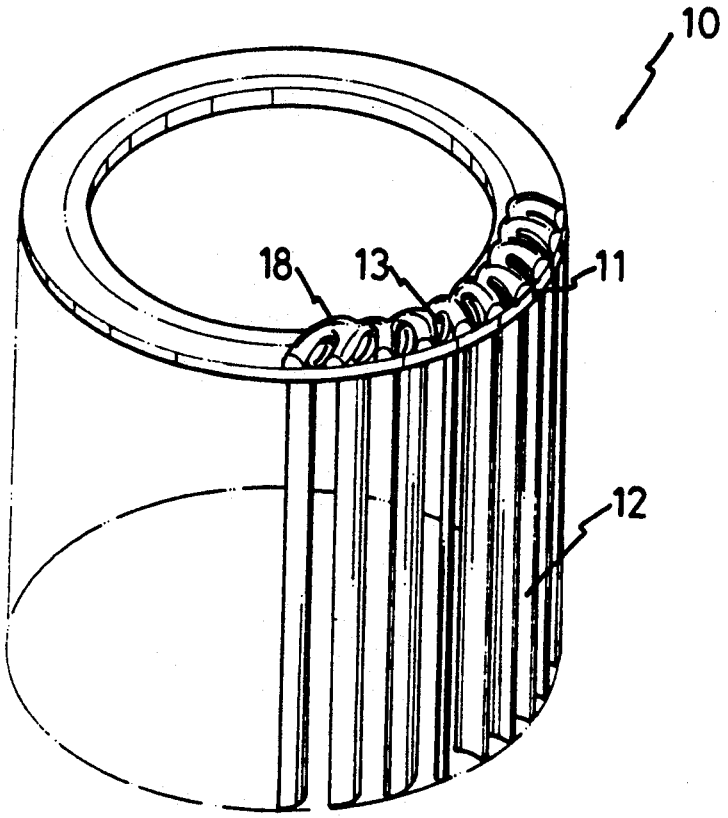
FIG. 8 is a perspective view of a centrifugal fan unit in accordance with a third embodiment of the present invention.

Referring to FIG. 8 illustrating a third embodiment of the present invention, a centrifugal fan unit 10 consists of an annular member 11 with a first side and a second side. A number of blades 12 integrate with and extend from the first side of the annular member 11.

Figure 9:
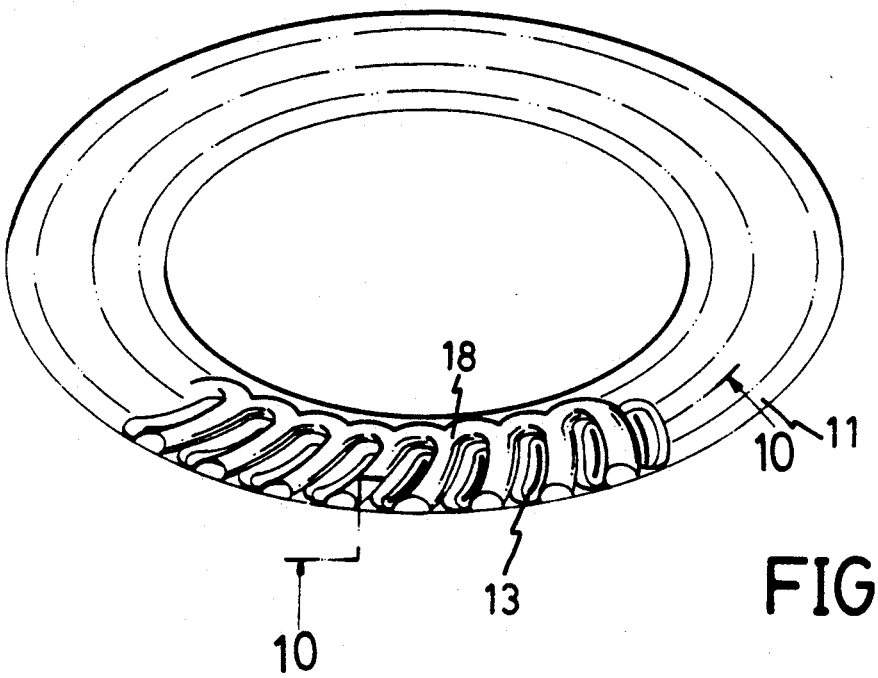
FIG. 9 is a perspective view of an annular member of a centrifugal fan unit in accordance with a second embodiment of the present invention.

Additionally referring to FIG. 9, a number of grooves 13 are formed in the second side of the annular member 11. A guide 18 is formed on the second side of the annular member 11. The guide 18 has a substantially circumferential portion and a number of substantially radial portions integrating with and extending from the substantially circumferential portion. In other words, the guide 18 can be deemed as the combination of the annular guide 15 in accordance with the first embodiment of the present invention and the guides 16 in accordance with the second embodiment of the present invention.

Figure 10:
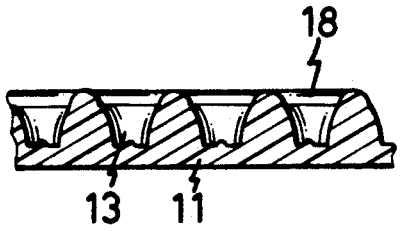
FIG. 10 is a vertical cross-sectional view taken along a line 10—10 in FIG. 9.

Additionally referring to FIG. 10, the grooves 13 and the substantially radial portions of the guide 18 are alternatively arranged. Each of the substantially radial portions of the guide 18 has two inclined sides permitting the blades 12 formed on one centrifugal fan unit 10 to enter in the grooves 13 formed in another centrifugal fan unit 10 even if there is a slight circumferential misalignment of the blades 12 with the grooves 13.

The substantially circumferential portion of the guide 18 has an inclined side for permitting the blades 12 formed on one centrifugal fan unit 10 to enter in the grooves 13 formed in another centrifugal fan unit 10 even if the blades 12 slightly radially misalign with the grooves 13.

The configurations of the guides.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

I claim:

1. A multi-sectional centrifugal blower fan unit comprising a plurality of sectional centrifugal blower fans;

each of said sectional centrifugal blower fans having an annular member with a first side and a second side, a number of blades integrating with an extending from said first side, a number of grooves in said second side of said annular member, a first guiding mean formed on said second side of said annular member, a second guiding means formed on said second side of said annular member, wherein said first and said second guiding means assist said blades to enter said grooves even though one of said sectional centrifugal blower fan blades are slightly misaligned with said grooves formed on the other sectional centrifugal blower fan when said centrifugal blower fans are assembled together.

2. A centrifugal fan unit in accordance with claim 1, wherein said first guiding means comprises a number of triangular guides each having two inclined rims and said grooves triangular guides are alternatively arranged.

3. A centrifugal fan unit in accordance with claim 1, wherein said first guiding means comprises a number of substantially radially extending guides each having two inclined sides, and said grooves are alternatively arranged.

4. A centrifugal fan unit in accordance with claim 1, wherein said second guiding means comprises an annular guides formed on said second side of said annular member.

5. A centrifugal fan unit in accordance with claim 1, wherein said first guiding means comprises a number of guides formed on said second side of said annular member.

* * * * *